US009347013B2

(12) United States Patent
Bertin

(10) Patent No.: US 9,347,013 B2
(45) Date of Patent: May 24, 2016

(54) NATURAL OIL DERIVATIVE BASED THICKENER COMPONENTS USED IN GREASE COMPOSITIONS AND PROCESSES FOR MAKING SUCH COMPOSITIONS

(71) Applicant: Elevance Renewable Sciences, Inc., Woodridge, IL (US)

(72) Inventor: Paul A. Bertin, Western Springs, IL (US)

(73) Assignee: Elevance Renewable Sciences, Inc., Woodridge, IL (US)

( * ) Notice: Subject to any disclaimer, the term of this patent is extended or adjusted under 35 U.S.C. 154(b) by 0 days.

(21) Appl. No.: 14/886,596

(22) Filed: Oct. 19, 2015

(65) Prior Publication Data

US 2016/0040088 A1 Feb. 11, 2016

Related U.S. Application Data

(63) Continuation of application No. 14/200,930, filed on Mar. 7, 2014, now abandoned.

(60) Provisional application No. 61/927,606, filed on Jan. 15, 2014.

(51) Int. Cl.

| | |
|---|---|
| ***C10M 173/00*** | (2006.01) |
| ***C10M 173/02*** | (2006.01) |
| ***C10M 117/04*** | (2006.01) |
| ***C10M 117/06*** | (2006.01) |
| ***C10M 117/00*** | (2006.01) |

(52) U.S. Cl.

CPC ..... *C10M 117/04* (2013.01); *C10M 117/00* (2013.01); *C10M 117/06* (2013.01); *C10M 2203/1006* (2013.01); *C10M 2205/0285* (2013.01); *C10M 2207/1276* (2013.01); *C10M 2207/1285* (2013.01); *C10M 2207/1296* (2013.01); *C10M 2207/2825* (2013.01); *C10M 2207/401* (2013.01); *C10N 2210/01* (2013.01); *C10N 2210/02* (2013.01); *C10N 2220/022* (2013.01); *C10N 2230/26* (2013.01); *C10N 2240/02* (2013.01); *C10N 2250/10* (2013.01)

(58) Field of Classification Search

CPC ..... C10M 2207/125; C10M 2207/401; C10M 2207/1206

USPC ..... 508/175, 178

See application file for complete search history.

(56) References Cited

U.S. PATENT DOCUMENTS

| | | | | |
|---|---|---|---|---|
| 3,200,073 | A | 8/1965 | Criddle | |
| 3,314,886 | A * | 4/1967 | Bodner | C10M 169/02 508/232 |
| 5,318,712 | A * | 6/1994 | Lange | C10M 135/00 508/231 |
| 2004/0092408 | A1 | 5/2004 | Willey et al. | |
| 2009/0062165 | A1 | 3/2009 | Denis et al. | |
| 2011/0195880 | A1 * | 8/2011 | Kawamura | C10M 169/00 508/144 |
| 2011/0218128 | A1 | 9/2011 | Hishinuma | |

OTHER PUBLICATIONS

Int'l Search Report & Written Opinion of the Int'l Searching Authority, PCT App. No. PCT/US2014/021877, dated Jul. 29, 2014.

Unpublished PCT App. No. PCT/US2008/009635, filed Aug. 11, 2008.

Pederson, "Handbook of Metathesis" Commercial Applications of Ruthenium Metathesis Processes, vol. 2, pp. 491-510 (2003).

* cited by examiner

*Primary Examiner* — Vishal Vasisth

(74) *Attorney, Agent, or Firm* — Robert S. Dailey; Nirav Patel

(57) ABSTRACT

A grease composition is disclosed, having from 75 to 85 weight percent of a lubricating base oil, from 15 to 25 weight percent of a thickener component including one or more of (i) one or more natural oil derivatives comprising octadecanedioic acid dimethyl esters, (ii) one or more carboxylic acids and/or derivatives thereof, comprising 12-hydroxystearic acid, and (iii) one or more of a metal base compound comprising lithium hydroxide, and from 1 to 15 weight percent of one or more optional additives. Processes for making grease compositions are also disclosed.

5 Claims, No Drawings

NATURAL OIL DERIVATIVE BASED THICKENER COMPONENTS USED IN GREASE COMPOSITIONS AND PROCESSES FOR MAKING SUCH COMPOSITIONS

CROSS REFERENCE TO RELATED APPLICATIONS

This application is a CON of Ser. No. 14/200,930, filed Mar. 7, 2014, now Abandoned, which claims benefit of 61/927,606, filed Jan. 15, 2014.

TECHNICAL FIELD

This application relates to natural oil derivative based thickener components used in grease compositions and processes for making such compositions.

BACKGROUND

A wide variety of greases have been developed over the years comprising a number of different formulations with a wide variation in associated properties. An important component found in greases is the thickening agent, which is often at least one metal soap, and differences in grease formulations have often involved this ingredient. Soap thickened greases constitute a significant segment by far of the commercially available greases worldwide. Simple soap greases, which are salts of long chain fatty acids and a neutralizing agent, are probably the most predominant type of grease in use today, with lithium 12-hydroxystearate being the thickener most often used. Complex soap greases, which generally comprise metal salts of a mixture of organic acids have also come into widespread use, particularly because of the various property advantages such type greases can possess (i.e. dropping points at least 20° C. higher than their corresponding simple soap greases).

We have found that the incorporation of certain natural oil derivatives as a thickener component in complex greases provides for greases with reduced processing times and improved yields.

SUMMARY

In one aspect, a grease composition is disclosed. The grease composition comprises from 50 to 99 weight percent of a lubricating base oil, and from 1 to 30 weight percent of a thickener component. The thickener component comprises one or more of (i) one or more natural oil derivatives selected from the group consisting of triglycerides, diglycerides, monoglycerides, or oligomers therefrom, fatty acid methyl esters and corresponding fatty acids, salts, and dibasic esters therefrom, and $C_{10}$-$C_{15}$ esters, $C_{15}$-$C_{18}$ esters, or $C_{18+}$ esters, or diesters therefrom, (ii) one or more carboxylic acids and/or derivatives thereof, and (iii) one or more of a metal base compound. In some embodiments, the natural oil derivative comprises octadecanedioic acid methyl esters. The grease composition may further comprise from 1 to 15 weight percent of one or more optional additives.

DETAILED DESCRIPTION

The present application relates to natural oil based grease compositions and processes for making such compositions.

As used herein, the singular forms "a," "an," and "the" include plural referents unless the context clearly dictates otherwise. For example, reference to "a substituent" encompasses a single substituent as well as two or more substituents, and the like.

As used herein, the terms "for example," "for instance," "such as," or "including" are meant to introduce examples that further clarify more general subject matter. Unless otherwise specified, these examples are provided only as an aid for understanding the applications illustrated in the present disclosure, and are not meant to be limiting in any fashion.

As used herein, the following terms have the following meanings unless expressly stated to the contrary. It is understood that any term in the singular may include its plural counterpart and vice versa.

As used herein, the term "natural oil" may refer to oil derived from plants or animal sources. The term "natural oil" includes natural oil derivatives, unless otherwise indicated. Examples of natural oils include, but are not limited to, vegetable oils, algae oils, animal fats, tall oils, derivatives of these oils, combinations of any of these oils, and the like. Representative non-limiting examples of vegetable oils include canola oil, rapeseed oil, coconut oil, corn oil, cottonseed oil, olive oil, palm oil, peanut oil, safflower oil, sesame oil, soybean oil, sunflower oil, linseed oil, palm kernel oil, tung oil, jatropha oil, mustard oil, camelina oil, pennycress oil, hemp oil, algal oil, and castor oil. Representative non-limiting examples of animal fats include lard, tallow, poultry fat, yellow grease, and fish oil. Tall oils are by-products of wood pulp manufacture. In certain embodiments, the natural oil may be refined, bleached, and/or deodorized. In some embodiments, the natural oil may be partially or fully hydrogenated. In some embodiments, the natural oil is present individually or as mixtures thereof.

As used herein, the term "natural oil derivatives" may refer to the compounds or mixture of compounds derived from the natural oil using any one or combination of methods known in the art. Such methods include metathesis, saponification, transesterification, esterification, interesterification, hydrogenation (partial or full), isomerization, amidation, oxidation, and reduction, individually or in combinations thereof. Representative non-limiting examples of natural oil derivatives include gums, phospholipids, waxes (e.g. non-limiting examples such as hydrogenated metathesized natural oil waxes and amidated hydrogenated metathesized natural oil waxes), soapstock, acidulated soapstock, distillate or distillate sludge, fatty acids and fatty acid alkyl ester (e.g. non-limiting examples such as 2-ethylhexyl ester), hydroxy substituted variations thereof of the natural oil. For example, the natural oil derivative may be a fatty acid methyl ester ("FAME") derived from the glyceride of the natural oil. In some embodiments, a feedstock includes canola or soybean oil, as a non-limiting example, refined, bleached, and deodorized soybean oil (i.e., RBD soybean oil). Soybean oil typically comprises about 95% weight or greater (e.g., 99% weight or greater) triglycerides of fatty acids. Major fatty acids in the polyol esters of soybean oil include saturated fatty acids, as a non-limiting example, palmitic acid (hexadecanoic acid) and stearic acid (octadecanoic acid), and unsaturated fatty acids, as a non-limiting example, oleic acid (9-octadecenoic acid), linoleic acid (9, 12-octadecadienoic acid), and linolenic acid (9,12,15-octadecatrienoic acid). In one embodiment, one particular natural oil derivative is hydrogenated castor oil, which is the glyceride of 12-hydroxystearic acid. In some embodiments, hydrogenation and saponification of castor oil yields 12-hydroxystearic acid, which is then reacted with lithium hydroxide or lithium carbonate to give high performance grease. In some embodiments, natural oil derivatives may arise from bottoms streams from a metathesis reactor, or from bottoms streams of downstream separation units from a metathesis reactor. Such bottoms streams may be primarily esters, where such esters may include triglycerides, diglycerides, monoglycerides, or oligomers therefrom, or fatty acid methyl esters ("FAME") and corresponding fatty acids, salts, and dibasic esters therefrom, or $C_{10}$-$C_{15}$ esters, $C_{15}$-$C_{18}$ esters, or $C_{18+}$ esters, or diesters therefrom, wherein such esters may occur as free esters or in combinations thereof. In some embodiments, such esters are preferably monoglycerides and/or fatty acid methyl esters. In some embodiments, such bottoms streams may include octadecanedioic acid methyl esters (ODDAME).

As used herein, the term "metathesis" or "metathesizing" refers to the reacting of a feedstock in the presence of a metathesis catalyst to form a metathesized product or "metathesized natural oil" comprising a new olefinic compound. Metathesizing may refer to cross-metathesis (a.k.a. co-metathesis), self-metathesis, ring-opening metathesis, ring-opening metathesis polymerizations ("ROMP"), ring-closing metathesis ("RCM"), and acyclic diene metathesis ("ADMET"). As a non-limiting example, metathesizing may refer to reacting two triglycerides present in a natural oil feedstock (self-metathesis) in the presence of a metathesis catalyst, wherein each triglyceride has an unsaturated carbon-carbon double bond, thereby forming a "natural oil oligomer" having a new mixture of olefins and esters that may comprise one or more of: metathesis monomers, metathesis dimers, metathesis timers, metathesis tetramers, metathesis pentamers, and higher order metathesis oligomers (e.g., metathesis hexamers). Examples of metathesis compositions, processes, and products are reported in R. L. Pederson, *Commercial Applications of Ruthenium Metathesis Processes*; in "Handbook of Metathesis"; Vol. 2; R. H. Grubbs Ed.; Wiley-VCH Weinheim, Germany; 2003; pp. 491 to 510 (ISBN No. 3-527-30616-1). Of note, both intra- and inter-molecular cross-metathesis of unsaturated fatty acid glycerides in soybean oil results in long chain (e.g. C18 or higher) latent diacids.

As used herein, the term "metathesized natural oil" refers to the product formed from the metathesis reaction of a natural oil in the presence of a metathesis catalyst to form a mixture of olefins and esters comprising one or more of: metathesis monomers, metathesis dimers, metathesis trimers, metathesis tetramers, metathesis pentamers, and higher order metathesis oligomers (e.g., metathesis hexamers). In certain embodiments, the metathesized natural oil has been partially to fully hydrogenated, forming a "hydrogenated metathesized natural oil." In certain embodiments, the metathesized natural oil is formed from the metathesis reaction of a natural oil comprising more than one source of natural oil (e.g., a mixture of soybean oil and palm oil). In other embodiments, the metathesized natural oil is formed from the metathesis reaction of a natural oil comprising a mixture of natural oils and natural oil derivatives.

As used herein, the term "dropping point," "drop point," or "melting point" are terms that may refer to the temperature at which the grease begins to melt. The drop point may be measured using ASTM-D127-08, ASTM D2265, or the Mettler Drop Point FP80 system, incorporated by reference herein.

As used herein, the term "needle penetration" may refer to the relative hardness of the grease composition. The needle penetration may be measured using ASTM-D1321-02a, incorporated by reference herein.

As used herein, the term "cone penetration" may refer to the measurement of the solidity of the grease. Penetration is the depth, in tenths of millimeters, to which a standard cone sinks into the grease under prescribed conditions. Thus higher penetration numbers indicate softer grease, since the cone has sunk deeper into the sample.

Grease Composition

The elements of a lubricating grease composition are generally divided among three parts: lubricating base oil, thickener, and additives. In general, the roles of these three parts is that the base oil carries out the main role of lubrication, the thickener structures the lubricating base oil into a semi-solid, and the additives impart additional functionality to the lubricating base oil and/or thickener, such as corrosion or oxidation resistance.

Lubricating Base Oil

The lubricating base oil employed in the grease composition can be any of the conventionally used lubricating oils, and is preferably a mineral oil, a synthetic oil or a blend of mineral and synthetic oils, or in some cases, natural oils and natural oil derivatives, all individually or in combinations thereof. Mineral lubricating oil base stocks used in preparing the greases can be any conventionally refined base stocks derived from paraffinic, naphthenic and mixed base crudes. The lubricating base oil may include polyolefin base stocks, of both polyalphaolefin (PAO) and polyinternal olefin (PIO) types. Oils of lubricating viscosity derived from coal or shale are also useful.

Examples of synthetic oils include hydrocarbon oils such as polymerized and interpolymerized olefins (e.g., polybutylenes, polypropylenes, propyleneisobutylene copolymers); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, and etherification, constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having a number average molecular weight of 1000, diphenyl ether of polyethylene glycol having a molecular weight of 500-1000, diethyl ether of polypropylene glycol having a molecular weight of 1000-1500) or mono- and polycarboxylic esters thereof, for example, the acetic acid esters, mixed $C_{3-8}$ fatty acid esters, or the $C_{13}$ Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di-(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. Esters useful as synthetic oils also include those made from $C_5$ to $C_{12}$ monocarboxylic acids and polyols such as neopentyl glycol, trimethylol propane, and pentaerythritol, or polyol ethers such as dipentaerythritol, and tripentaerythritol.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl) silicate, tetra-(4-methylhexyl) silicate, tetra-(p-tert-butylphenyl) silicate, hexyl-(4-methyl-2-pentoxy) disiloxane, poly (methyl) siloxanes, and poly-(methylphenyl) siloxanes). Other synthetic lubricating oils include liquid esters of phosphorus-containing acids (e.g., tricresyl phosphate, trioctyl phosphate, and the diethyl ester of decane phosphonic acid), and polymeric tetrahydrofurans.

Unrefined, refined and re-refined oils, either natural or synthetic (as well as mixtures of two or more of any of these) of the type disclosed hereinabove can be used as the lubricating base oil in the grease composition. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, re-refined oils are obtained by processes similar to those used to obtain refined oils applied to refined oils which have been already used in service. Such re-refined oils are also known as reclaimed or reprocessed oils and often are additionally processed by techniques directed to removal of spent additives and oil breakdown products.

Oils of lubricating viscosity can also be defined as specified in the American Petroleum Institute (API) Base Oil Interchangeability Guidelines. The five base oil groups are as follows:

| Base Oil Category | Sulfur (%) | Saturates (%) | Viscosity index |
|---|---|---|---|
| Group II | >0.03 | and/or <90 | 80-120 |
| Group II | ≤0.03 | and ≥90 | 80-120 |
| Group III> | | | |
| Group IV | All polyalphaolefins (PAOs) | | |
| Group V | All others not included in Groups I, II, III, or IV | | |

Groups I, II, and III are mineral oil base stocks. In some embodiments, the oil of lubricating viscosity is a Group I, II, III, IV, or V oil or mixtures thereof.

The lubricating base oil is present in a "major amount," meaning greater than about 50 weight percent of the grease composition, preferably in the range 50 to 99 weight percent of the grease composition, preferably 60 to 95 weight percent of the grease composition, more preferably 70 to 92 weight percent of the grease composition and most preferably 75 to 90 weight percent of the grease composition. In general these lubricating oils have a viscosity in the range of 15 to 220, preferably 30 to 150 cSt at 40° C., and a viscosity index in the range of 30 to 170, preferably 30 to 140.

Thickener

Another component in the subject grease composition is a thickener which serves to increase the consistency of the composition. In some embodiments, the thickener generally comprises one or more of the following: (i) one or more natural oil derivatives selected from the group consisting of triglycerides, diglycerides, monoglycerides, or oligomers therefrom, fatty acid methyl esters and corresponding fatty acids, salts, and dibasic esters therefrom, and $C_{10}$-$C_{15}$ esters, Cis-$C_{18}$ esters, or $C_{18+}$ esters, or diesters therefrom, (ii) one or more carboxylic acids and/or derivatives thereof, and (iii) one or more of a metal base compound.

The thickener may be present in a "minor amount," meaning less than about 50 weight percent of the grease composition, preferably in the range of 1 to 30 weight percent of the grease composition, and more preferably 5 to 20 weight percent of the grease composition, and most preferably 10 to 20 weight percent of the grease composition. Generally, the function of the thickener is to provide a physical matrix which holds the lubricating base oil in a solid structure until operating conditions initiate viscoelastic flow.

A. Natural Oil Derivatives

In some embodiments, the thickener may have a component comprising a natural oil derivative, wherein such derivative arises from bottoms streams from a metathesis reactor, or from bottoms streams of downstream separation units from a metathesis reactor. Such bottoms streams may be primarily esters, where such esters may include triglycerides, diglycerides, monoglycerides, or oligomers therefrom, or fatty acid methyl esters ("FAME") and corresponding fatty acids, salts, and dibasic esters therefrom, or $C_{10}$-$C_{15}$ esters, $C_{15}$-$C_{18}$ esters, or $C_{18+}$ esters, or diesters therefrom, wherein such esters may occur as free esters or in combinations thereof. In some embodiments, such esters are preferably monoglycerides and/or fatty acid methyl esters.

In some embodiments, the fatty acid methyl esters may include $C_{10}$-$C_{17}$ methyl esters, non-limiting examples of which include methyl 9-decenoate ("9-DAME"), methyl 10-undecenoate ("10-UDAME"), and methyl 9-dodecenoate ("9-DDAME"), respectively, and their corresponding fatty acids (via hydrolysis) would be 9-decenoic acid ("9DA"), 9-undecenoic acid ("9UDA"), and 9-dodecenoic acid ("9DDA"). In some embodiments, the methyl esters may be derived from 9-tridecenoic acid, 9-tetradecenoic acid, 9-pentadecenoic acid, 9-hexadecenoic acid, 9-heptadecenoic acid, and the like. In some embodiments, the fatty acid may be a C18 diacid such as 9-octadecenedioic acid (9-ODDA), which can be generated by the metathesis of 9DA and/or 9DDA. The 9-ODDA may be hydrolyzed to its corresponding acid, octadecanedioic acid (ODDA).

In some embodiments, the bottoms stream may include diesters, including a C18 diester such as dimethyl 9-octadecenedioate (9-ODDAME), which can be generated by the self-metathesis of methyl oleate. The 9-ODDAME could be produced by: (i) cross-metathesis of 9-DAME with 9-DDAME to form cis/trans 9-ODDAME and 1-butene; (ii) cross-metathesis of 9-DAME with 9-UDAME to form cis/trans 9-ODDAME and 1-propene; (iii) self-metathesis of 9-DDAME to form cis/trans 9-ODDAME and 3-hexene; and (iv) self-metathesis of 9-UDAME to form cis/trans 9-ODDAME and 2-butene. The 9-ODDAME may undergo hydrogenation to yield its saturated counterpart, octadecanedioic acid methyl esters (ODDAME). In some embodiments, the ODDAME may be at least 50% w/w purity, or at least 70% w/w purity, or at least 80% w/w purity, or at least 95% w/w purity.

Metathesis is a catalytic reaction generally known in the art that involves the interchange of alkylidene units among compounds containing one or more double bonds {e.g., olefinic compounds) via the formation and cleavage of the carbon-carbon double bonds. Metathesis may occur between two like molecules (often referred to as self-metathesis) and/or it may occur between two different molecules (often referred to as cross-metathesis). Self-metathesis may be represented schematically as shown in Equation I.

$$R^1—CH=CH—R^2+R^1—CH=CH—R^2 \leftrightarrow R^1—CH=CH—R^1+R^2—CH=CH—R^2 \quad (I)$$

wherein $R^1$ and $R^2$ are organic groups.

Cross-metathesis may be represented schematically as shown in Equation II.

$$R^1—CH=CH—R^2+R^3—CH=CH—R^4 \leftrightarrow R^1—CH=CH—R^3+R^1—CH=CH—R^4+R^2—CH=CH—R^3+R^2—CH=CH—R^4+R^1—CH=CH—R^1+R^2—CH=CH—R^2+R^3—CH=CH—R^3+R^4—CH=CH—R^4 \quad (II)$$

wherein $R^1$, $R^2$, $R^3$, and $R^4$ are organic groups.

In one embodiment, the hydrogenated metathesized natural oil based wax may be produced by the steps of: (a) providing a metathesis composition; (b) providing a metathesis catalyst comprising a transition metal; (c) metathesizing at least a portion of the metathesis composition in the presence of the metathesis catalyst to form a first composition comprising one or more metathesis products and transition metal; (d) hydrogenating at least a portion of the first composition in the presence of a hydrogenation catalyst to form a second composition comprising one or more hydrogenated metathesis products, transition metal, and hydrogenation catalyst; and (e) removing at least a portion of the hydrogenation catalyst from the second composition, wherein the removal of the hydrogenation catalyst removes at least a portion of the transition metal of the metathesis catalyst from the second composition.

In some embodiments, the metathesis compositions comprise polyol esters of unsaturated fatty acids. The polyol esters typically comprise one or more of monoacylglycerides, diacylglycerides, and triacylglycerides. The polyol esters are derived, for example, from natural oils. In one embodiment, the metathesis composition is refined, bleached, and deodorized (i.e., RBD) soybean oil. The metathesis compositions may include esters of the fatty acids provided by the oils and fats and molecules with a single hydroxy site such as fatty acid methyl esters.

As used herein, "polyol esters" refers to esters produced from polyols. Polyols may include more than two hydroxyl groups. These polyols may comprise from two to about 10 carbon atoms, and may comprise from two to six hydroxyl groups, but other numbers of carbon atoms and/or hydroxyl groups are possible as well. The polyols may contain two to four hydroxyl moieties. Non-limiting examples of polyols include glycerin, 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, neopentyl glycol, 2,2,4-trimethyl-1,3-pentanediol, trimethylolpropane (TMP), sorbitol and pentaerythritol. Very commonly, the polyol esters employed herein are esters of glycerin, e.g., triacylglycerides, or esters of a mixture of glycerin and one or more other polyols.

The polyol ester component may include a partial fatty acid ester of one or more polyols and/or a polyol which is fully esterified with fatty acids ("complete polyol fatty acid ester"). Examples of complete polyol fatty acid esters include triacylglycerides, propylene glycol diesters and tetra esters of pentaerythritol. Examples of suitable polyol partial esters include fatty acid monoglycerides, fatty acid diglycerides and sorbitan partial esters (e.g., diesters and triesters of sorbitan). In some embodiments, the polyol may include from 2 to 6 carbon atoms and 2 to 6 hydroxyl groups. Examples of suitable polyols include glycerol, trimethylolpropane, ethylene glycol, propylene glycol, pentaerythritol, sorbitan and sorbitol.

In some embodiments, the natural oil derivatives may arise from bottoms streams from a metathesis reactor, or from bottoms streams of downstream separation units from a metathesis reactor. Such bottoms streams may be primarily esters, where such esters may include triglycerides, diglycerides, monoglycerides, or oligomers therefrom, or fatty acid methyl esters ("FAME") and corresponding fatty acids, salts, and dibasic esters therefrom, or $C_{10}$-$C_{15}$ esters, $C_{15}$-$C_{18}$ esters, or $C_{18+}$ esters, or diesters therefrom, wherein such esters may occur as free esters or in combinations thereof. In some embodiments, such esters are preferably monoglycerides and/or fatty acid methyl esters. In some embodiments, such bottoms streams may include octadecanedioic acid methyl esters (ODDAME).

The term "metathesis catalyst" includes any catalyst or catalyst system that catalyzes a metathesis reaction. Any known or future-developed metathesis catalyst may be used, individually or in combination with one or more additional catalysts. Non-limiting exemplary metathesis catalysts and process conditions are described in PCT/US2008/009635, pp. 18-47, incorporated by reference herein. A number of the metathesis catalysts as shown are manufactured by Materia, Inc. (Pasadena, Calif.). Additional exemplary metathesis catalysts include, without limitation, metal carbene complexes selected from the group consisting of molybdenum, osmium, chromium, rhenium, and tungsten. The term "complex" in this context refers to a metal atom, such as a transition metal atom, with at least one ligand or complexing agent coordinated or bound thereto. Such a ligand typically is a Lewis base in metal carbene complexes useful for alkyne or alkene-metathesis. Typical examples of such ligands include phosphines, halides and stabilized carbenes. Some metathesis catalysts may employ plural metals or metal co-catalysts (e.g., a catalyst comprising a tungsten halide, a tetraalkyl tin compound, and an organoaluminum compound). An immobilized catalyst can be used for the metathesis process. An immobilized catalyst is a system comprising a catalyst and a support, the catalyst associated with the support. Exemplary associations between the catalyst and the support may occur by way of chemical bonds or weak interactions (e.g. hydrogen bonds, donor acceptor interactions) between the catalyst, or any portions thereof, and the support or any portions thereof. Support is intended to include any material suitable to support the catalyst. Typically, immobilized catalysts are solid phase catalysts that act on liquid or gas phase reactants and products. Exemplary supports are polymers, silica or alumina. Such an immobilized catalyst may be used in a flow process. An immobilized catalyst can simplify purification of products and recovery of the catalyst so that recycling the catalyst may be more convenient.

The metathesis process can be conducted under any conditions adequate to produce the desired metathesis products. For example, stoichiometry, atmosphere, solvent, temperature and pressure can be selected to produce a desired product and to minimize undesirable byproducts. The metathesis process may be conducted under an inert atmosphere. Similarly, if the olefin reagent is supplied as a gas, an inert gaseous diluent can be used. The inert atmosphere or inert gaseous diluent typically is an inert gas, meaning that the gas does not interact with the metathesis catalyst to substantially impede catalysis. For example, particular inert gases are selected from the group consisting of helium, neon, argon, nitrogen and combinations thereof.

Similarly, if a solvent is used, the solvent chosen may be selected to be substantially inert with respect to the metathesis catalyst. For example, substantially inert solvents include, without limitation, aromatic hydrocarbons, such as benzene, toluene, xylenes, etc.; halogenated aromatic hydrocarbons, such as chlorobenzene and dichlorobenzene; aliphatic solvents, including pentane, hexane, heptane, cyclohexane, etc.; and chlorinated alkanes, such as dichloromethane, chloroform, dichloroethane, etc.

In certain embodiments, a ligand may be added to the metathesis reaction mixture. In many embodiments using a ligand, the ligand is selected to be a molecule that stabilizes the catalyst, and may thus provide an increased turnover number for the catalyst. In some cases the ligand can alter reaction selectivity and product distribution. Examples of ligands that can be used include Lewis base ligands, such as, without limitation, trialkylphosphines, for example tricyclohexylphosphine and tributyl phosphine; triarylphosphines, such as triphenyiphosphine; diarylalkylphosphines, such as, diphenylcyclohexylphosphine; pyridines, such as 2,6-dimethylpyridine, 2,4,6-trimethylpyridine; as well as other Lewis basic ligands, such as phosphine oxides and phosphinites. Additives may also be present during metathesis that increase catalyst lifetime.

Any useful amount of the selected metathesis catalyst can be used in the process. For example, the molar ratio of the unsaturated polyol ester to catalyst may range from about 5:1 to about 10,000,000:1 or from about 50:1 to 500,000:1.

The metathesis reaction temperature may be a rate-controlling variable where the temperature is selected to provide a desired product at an acceptable rate. The metathesis temperature may be greater than −40° C., may be greater than about −20° C., and is typically greater than about 0° C. or greater than about 20° C. Typically, the metathesis reaction temperature is less than about 150° C., typically less than about 120° C. An exemplary temperature range for the metathesis reaction ranges from about 20° C. to about 120° C.

The metathesis reaction can be run under any desired pressure. The total pressure may be selected to be greater than about 10 kPa, in some embodiments greater than about 30 kPa, or greater than about 100 kPa. Typically, the reaction pressure is no more than about 7000 kPa, in some embodiments no more than about 3000 kPa. An exemplary pressure range for the metathesis reaction is from about 100 kPa to about 3000 kPa.

In some embodiments, the metathesis reaction is catalyzed by a system containing both a transition and a non-transition metal component. The most active and largest number of catalyst systems are derived from Group VI A transition metals, for example, tungsten and molybdenum.

C. Carboxylic Acids and Derivatives

The carboxylic acid has about 2 to about 36, preferably about 6 to about 24, more preferably about 9 to about 20 carbon atoms, and mono-, di-, tri-, and/or poly-acid variants, hydroxy-substituted variants, aliphatic, cyclic, alicyclic, aromatic, branched, aliphatic- and alicyclic-substituted aromatic, aromatic-substituted aliphatic and alicyclic groups, saturated and unsaturated variants, and heteroatom substituted variants thereof. In some embodiments, the mono- or di-esters or poly-esters of these acids thereof may be used. Non-limiting examples of such carboxylic acids include lauric acid, azelaic acid, myristic acid, palmitic acid, arachic acid, behenic acid, lignoceric acid, oleic acid, linoleic acid, linolenic acid, capric acid, lignoceric acid, decenoic acid, undecenoic acid, dodecenoic acid, ricinoleic acid, myristoleic acid, palmitoleic acid, gadoleic acid, elaidic acid, cis-eicosenoic acid, erucic acid, nervonic acid, 2,4-hexadienoic acid, linoleic acid, 12-hydroxy tetradecanoic acid, 10-hydroxy tetradeconoic acid, 12-hydroxy hexadecanoic acid, 8-hydroxy hexadecanoic acid, 12-hydroxy icosanic acid, 16-hydroxy icosanic acid 11,14-eicosadienoic acid, linolenic acid, cis-8,11,14-eicosatrienoic acid, arachidonic acid, cis-5,8,11,14,17-eicosapentenoic acid, cis-4,7,10,13,16,19-docosahexenoic acid, all-trans-retinoic acid, lauroleic acid, eleostearic acid, licanic acid, citronelic acid, nervonic acid, abietic acid, abscisic acid, octanedioic acid, nonanedioic acid (azelaic acid), decanedioic acid (sebacic acid), undecanedioic acid, dodecanedioic acid, tridecanedioic acid, tetradecanedioic acid, pentadecanoic acid and mixtures thereof. In some embodiments, azelaic acid is a preferred carboxylic acid. In some embodiments, naphthenic acids and mixtures thereof, such as are obtainable from various petroleum sources, may be used. Other non-limiting examples, such as hydroxystearic, hydroxy-ricinoleic, hydroxybehenic and hydroxypalmitic acids may be used, preferably hydroxystearic acid or esters of these acids such as 9-hydroxy-, 10-hydroxy- or 12-hydroxy-stearic acid, and most preferably 12-hydroxystearic acid.

D. Metal Base Compound

In the metal base compound, the metals themselves can be selected from alkali metals or alkaline earth metals, such as, without limitation, beryllium, magnesium, calcium, lithium, sodium, potassium, strontium and barium; transition metals, without limitation, such as titanium, vanadium, chromium, manganese, iron, cobalt, nickel, copper, zinc, zirconium, molybdenum, palladium, silver, cadmium, tungsten and mercury; and other metals such as aluminum, gallium, tin, iron, lead, and lanthanoid metals, all individually or in combinations thereof. Said metals are more preferably selected from lithium, sodium, magnesium, aluminum, calcium, zinc and barium. Examples of carboxylic acid metal salts which may be conveniently used in the present invention are metal salts of any combination of a mono- or poly-carboxylic; branched alicyclic, cyclic, cycloalkyl, or linear, saturated or unsaturated, mono- or poly-hydroxy substituted or unsubstituted carboxylic acid, acid chloride or the ester of said carboxylic acid with an alcohol such as an alcohol of about 1 to about 5 carbon atoms. As for the base compound, the alkoxides, oxides, hydroxides, carbonates, chlorides, and mixtures thereof of any of the aforementioned metals are found to be especially useful. In some embodiments, hydroxides of these aforementioned metals are preferred, and calcium hydroxide, strontium hydroxide, magnesium hydroxide, sodium hydroxide, and lithium hydroxide are more preferred. The metal hydroxide is a mono- or di- or tri-valent metal or a mixture thereof. In one embodiment the metal hydroxide is lithium hydroxide monohydrate and can be solid or aqueous, although aqueous is preferred.

In some embodiments, the metal base, usually a metal hydroxide, such as lithium hydroxide or in its more commonly available form of lithium hydroxide monohydrate, is reacted with a carboxylic acid, usually 12-hydroxystearic acid, or with a carboxylic acid derivative, usually 12-hydroxystearate or hydrogenated castor oil, to form a metallic (lithium) soap. This reaction is most often carried out in the lubricating base oil with water also being present. The water is added to act as a reaction solvent if the acid is used. If the carboxylic acid derivative is used, the water acts both as reaction solvent and reactant, the latter effect being necessary for the hydrolytic cleavage of the ester linkages in the 12-hydroxystearate or the hydrogenated castor oil. In some embodiments, the lithium hydroxide is reacted with two or more carboxylic acids, such as 12-hydroxystearic acid and azelaic acid, to form a metallic (lithium) soap.

Optional Grease Additives

Various optional additives may be incorporated into the grease compositions of this invention, for the particular service intended. Such optional additives that may commonly be used include: metal deactivators, antioxidants, antiwear agents, rust inhibitors, viscosity modifiers, extreme pressure agents, corrosion inhibitors, and other additives recognized in the art to perform a particular function or functions. Such additives may be present in the range of 1 to 15 weight percent of the grease composition, and more preferably 3 to 10 weight percent of the grease composition.

Metal deactivators may include derivatives of benzotriazoles, benzimidazole, 2-alkyldithiobenz-imidazoles, 2-alkyldithiobenzothiazoles, 2-(N,N-dialkyldithiocarbamoyl)-benzothiazoles, 2,5-bis(alkyl-dithio)-1,3,4-thiadiazoles, 2,5-bis (N,N-dialkyldithio-carbamoyl)-1,3,4-thiadiazoles, 2-alkyldithio-5-mercapto thiadiazoles or mixtures thereof. Antioxidants may include a variety of chemical types including phenate sulfides, phosphosulfurized terpenes, sulfurized esters, aromatic amines, and hindered phenols. Antiwear agents may include a metal thiophosphate, especially a zinc dialkyldithiophosphate; a phosphoric acid ester or salt thereof; a phosphite; and a phosphorus-containing carboxylic ester, ether, or amide. Rust inhibitors may include metal sulfonates such as calcium sulfonate or magnesium sulfonate, amine salts of carboxylic acids such as octylamine octanoate, condensation products of dodecenyl succinic acid or anhydride and a fatty acid such as oleic acid with a polyamine, e.g. a polyalkylene polyamine such as triethylenetetramine, and half esters of alkenyl succinic acids in which the alkenyl radical contains 8 to 24 carbon atoms with alcohols such as polyglycols.

Viscosity modifiers may include polymeric materials including styrene-butadiene rubbers, ethylene-propylene copolymers, polyisobutenes, hydrogenated styrene-isoprene polymers, hydrogenated radical isoprene polymers, polymethacrylate acid esters, polyacrylate acid esters, polyalkyl styrenes, alkenyl aryl conjugated diene copolymers, polyolefins, polyalkylmethacrylates, esters of maleic anhydride-styrene copolymers and mixtures thereof. Extreme Pressure (EP) Agents may include agents that are soluble in the oil include a sulfur or chlorosulfur EP agent, a chlorinated hydrocarbon EP agent, or a phosphorus EP agent, or mixtures thereof. Examples of such EP agents are chlorinated wax, organic sulfides and polysulfides, such as benzyldisulfide, bis-(chlorobenzyl) disulfide, dibutyl tetrasulfide, sulfurized sperm oil, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphites, i.e., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite, metal thiocarbamates, such as zinc dioctyldithiocarbamate and barium heptylphenol diacid, such as zinc dicyclohexyl phosphorodithioate and the zinc salts of a phosphorodithioic acid combination may be used. Corrosion inhibitors may include: mercaptobenzothiazole, barium dinonylnaphthalene sulfonate, glycerol monooleate, sodium nitrite, and imidazolines of tetraethylenepentamine, among others.

Uses/Applications for the Grease Compositions

The grease compositions described herein are useful for lubricating, sealing and protecting mechanical components such as gears, axles, bearings, shafts, hinges and the like. Such mechanical components are found in automobiles, trucks, bicycles, steel mills, mining equipment, railway equipment including rolling stock, aircraft, boats, construction equipment and numerous other types of industrial and consumer machinery. The grease compositions described herein may be used in various applications, including, but not limited to, lubricating surface mining machinery (pins and bushings, open gears in large electric shovels), constant velocity joints (CV joints), ball bearings, journal bearings, high speed low load machinery lubrication, low speed-high load machinery lubrication, conveyor belt bearings lubrication, gears lubrication, open gears lubrication, curve and flange rail lubrication, traction motor gear lubrication, high temperature highly corrosive media lubrication, wheel bearing lubrication of motor vehicles and trucks, journal bearing lubrication of freight and high speed trains, paper machinery lubrication, lawn and garden machinery lubrication, pipe dope anti seize lubrication, automotive tie rod ends, roof, seating and steering mechanism lubrication, jacks and landing gear equipment lubrication, continuous caster and hot mills bearing lubrication, lubrication of garage door mechanisms and oven chain lubrication.

Grease Preparation

Greases can be manufactured in several consistencies as defined by National Lubricating Grease Institute (N.L.G.I.) as described in ASTM Method D-217 for Cone Penetration of Lubricating Greases. Adjusting the lubricating base oil, thickener component, and additive content will permit the manufacture of various grades of greases.

As is well known in the art, greases are sold in various grades depending upon the softness of the grease. The softer the grease, the more fluid the grease. For example, very soft greases sold under the designation NLGI 0 have a cone penetration number from about 355 to 385, those having a cone penetration range of 310 to 340 are designated NLGI 1 and the most widely sold greases have a cone penetration range of 265 to 295 and are designated NLGI 2. Table 1 below shows the various NLGI grades for greases.

TABLE 1

NLGI Grades for greases

| NLGI Grade | Worked Cone Penetration (ASTM D 217) @ 77° F. |
|---|---|
| 000 | 445-475 |
| 00 | 400-430 |
| 0 | 355-385 |
| 1 | 310-340 |
| 2 | 265-295 |
| 3 | 220-250 |
| 4 | 175-205 |
| 5 | 130-160 |
| 6 | 85-115 |

Since there are a variety of different greases with varying formulations and properties and since such properties can be altered, sometimes significantly, by changes in process conditions and apparatus, a great deal of flexibility is needed in the process equipment for manufacturing greases. Because of the desired flexibility and because many greases are specialty type greases made in small amounts, most grease manufacturing has been of the batch type.

Batch processing generally comprises the use of one or more large kettles that may be equipped with, for example, paddle agitation, stirring, heating, external recirculation systems capable of pumping the contents from the bottom of the kettle to the top, and combinations thereof. As used herein, the terms kettle and vessel may be used interchangeably. The kettles that may be utilized herein may be of a size generally in a range of from 500 liters to 20,000 liters, preferably in a range of from 2,000 liters to 15,000 liters, and more preferably in a range of from 3,000 liters to 10,000 liters. Examples of suitable kettles include open kettles and pressurized kettles. An example grease kettle is equipped with stirring, heating, and an external recirculation system, capable of pumping the contents from the bottom of the kettle to the top. The kettles may have heating means, cooling means, paddle type stirrers, gear-type circulation pumps, circulation line, back pressure shear valve in said circulation line, colloid mill, product filter, and other associated piping, valves, instrumentation, etc. required for the commercial manufacture of grease. The grease may also be passed through a grease mill again to obtain a further improvement in yield and appearance, where such mills may include a Morehouse mill, a Charlotte mill, and a Gaulin homogenizer.

Another type of batch processor sometimes used is a Stratco® mixer which has a different internal mixing configuration. In this equipment, the material is circulated by an impeller located at the bottom of the vessel, where it is possible to obtain rapid circulation and thorough mixing.

In some embodiments, the grease compositions described herein may also encompass complex greases. Complex greases are formed by reaction of a metal-containing reagent with two or more acids. One of the acids is (i) a hydroxy carboxylic acid or reactive derivative thereof, such as a C9-C24 hydroxystearic acid, preferably 9-hydroxy, 10-hydroxy, or 12-hydroxystearic acid, or the mono- or di-esters or poly-esters thereof, and (ii) one or more natural oil derivatives selected from the group consisting of triglycerides, diglycerides, monoglycerides, or oligomers therefrom, fatty acid methyl esters and corresponding fatty acids, salts, and dibasic esters therefrom, and $C_{10}$-$C_{15}$ esters, $C_{15}$-$C_{18}$ esters, or $C_{18+}$ esters, or diesters therefrom. As a control experiment, a dicarboxylic acid, such as one or more straight or branched chain $C_2$-$C_{12}$ dicarboxylic acids, examples of which may include oxalic, malonic, succinic, glutaric, adipic, suberic, pimelic, azelaic, dodecanedioic and sebacic acids, preferably azelaic acid, or the mono- or di-esters or poly-esters thereof, was used. Optionally, an additional hydroxy carboxylic acid may be utilized, where such acid has from 3 to 14 carbon atoms and can be either an aliphatic acid such as lactic acid, 6-hydroxy decanoic acid, 3-hydroxybutanoic acid, 4-hydroxybutanoic acid, etc. or an aromatic acid such as parahydroxybenzoic acid, salicylic acid, 2-hydroxy-4-hexylbenzoic acid, meta hydroxybenzoic acid, 2,5-dihydroxybenzoic acid; 2,6-dihydroxybenzoic acid; 4-hydroxy-3-methoxybenzoic acid, etc. or a hydroxyaromatic aliphatic acid such as orthohydroxyphenyl, metahydroxyphenyl, or parahydroxyphenyl acetic acid. A cycloaliphatic hydroxy acid such as hydroxy cyclopentyl carboxylic acid or hydroxynaphthenic acid could also be used. There is no absolute industry standard defining the dropping point of a complex grease. However, it is often accepted that minimum dropping points of about 260° C. are displayed by complex greases. Generally, a complex grease is one which displays a dropping point significantly higher, typically at least about 20° C. higher, than the corresponding simple metal soap grease.

To prepare the complex greases described herein, the various thickener components (one or more of: carboxylic acids, and/or natural oil derivative, and metal base) are added to a lubricating base oil, and this mixture is charged to a kettle, mixer, or equivalent vessel. Preferably, these thickener components are 12-hydroxystearic acid, octadecanedioic acid methyl esters (ODDAME), lithium hydroxide monohydrate, and the lubricating base oil is PAO 6. In a first stage, a portion of PAO 6 and all 12-hydroxystearic acid were added to a vessel and heated to 80° C. (176° F.) until a homogeneous melt formed. Lithium hydroxide monohydrate (1 equiv) was mixed with deionized water and gently heated. This metal base was then added to the oil solution under constant mechanical stirring and heated to about 100° C. (212° F.) for about 1 hour to complete neutralization. In a second stage, ODDAME was then added to the vessel followed by additional lithium hydroxide monohydrate (2.05 equiv) necessary to saponify this dibasic ester. The reaction was gradually heated to 200° C. (392° F.) to complete lithium soap thickener formation and facilitate dehydration and evaporation of methanol.

Thereafter, the mixture is then transferred to a finishing kettle or equivalent vessel for cooling. This cooling may be assisted by incorporating additional lubricating base oil into the mixture. Mixing can be continued until the grease reaches ambient temperatures. After about 90 minutes into this cooling phase, the heat is removed, and at about 1 hour thereafter, optional grease additives may be added to the finishing kettle. The grease may be finished by homogenization at 6000 psi.

In some embodiments, a thickener component may arise from bottoms streams from a metathesis reactor, or from bottoms streams of downstream separation units from a metathesis reactor, and may include bottoms streams such as octadecanedioic acid methyl esters (ODDAME). Upon saponification during processing with a metal hydroxides such as lithium hydroxide, ODDAME will yield the dilithium salt of octadecanedioic acid (ODDA). Venting of methanol byproduct during soap formation is acceptable in grease processes as the methyl ester of 12-HSA is used in continuous grease production facilities.

FIG. 2 below illustrates a representative reaction between ODDAME and 12-HSA.

FIG. 2. Reaction of ODDAME with 12-HSA as complexing agent.

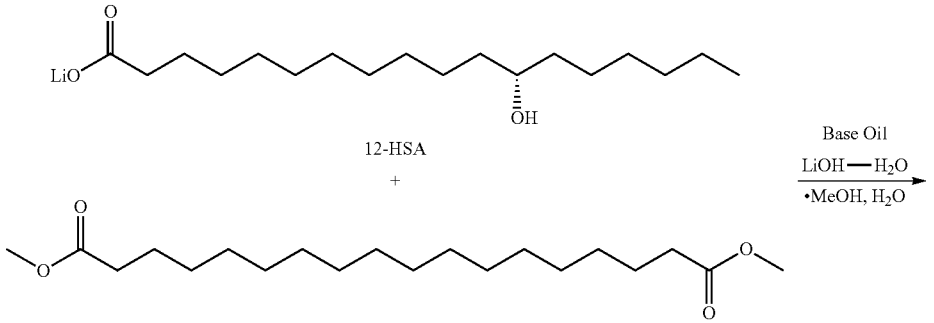

-continued

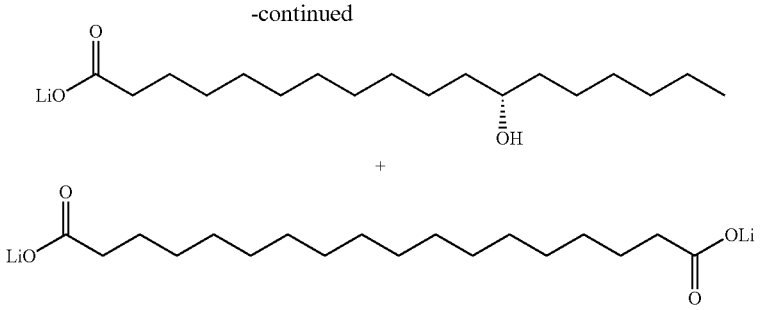

Of note, ODDA has a melting point between azelaic and sebacic acids and is about 1.5 times more oil soluble than azelaic acid. The expected benefits of an ODDAME complexing agent over azelaic acid include increased solvency in nonpolar synthetic base oil (i.e. PAO), improved water resistance of the final grease, differentiated additive loading if fiber packing is more porous, and high temperature performance. The improved oil solubility of ODDAME may enable complex grease processing at lower temperatures. Beyond lithium complex greases, ODDAME may also favorably impact aluminum and calcium complex grease products. Table 1A below compares the melting points and oil solubilities (Log P values) of common grease complexing agents with ODDA.

TABLE 1A

Physical properties of common grease complexing agents and ODDA.

| Diacid | Structure | Mp (° C.) | Log P |
|---|---|---|---|
| Adipic (C6) | 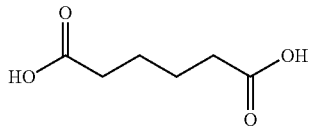 | 153 | 1.68 |
| Azelaic (C9) | 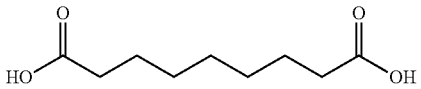 | 108 | 2.01 |
| Sebacic (C10) | 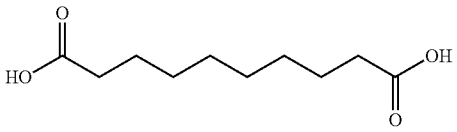 | 134 | 2.12 |
| ERS ODDA (C18) | 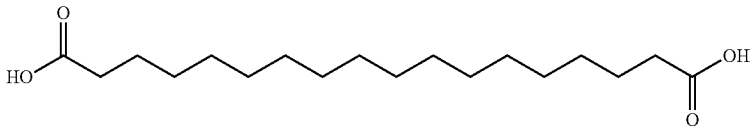 | 125 | 3.00 |

While the invention as described may have modifications and alternative forms, various embodiments thereof have been described in detail. It should be understood, however, that the description herein of these various embodiments is not intended to limit the invention, but on the contrary, the intention is to cover all modifications, equivalents, and alternatives falling within the spirit and scope of the invention as defined by the claims. Further, while the invention will also be described with reference to the following non-limiting examples, it will be understood, of course, that the invention is not limited thereto since modifications may be made by those skilled in the art, particularly in light of the foregoing teachings.

EXAMPLES

Example 1

A two stage reaction process was used to prepare a lithium 12-hydroxystearate complex grease using Sample A, which was a 71% w/w purity ODDAME. The first stage of the reaction consisted of reacting a stoichiometric amount of lithium hydroxide monohydrate with 12-hydroxystearic acid. In the second stage, the required amount of metal base was reacted with Sample A. The grease formulation was 20% thickener and 80% PAO-6. The thickener composition was 73% lithium hydroxystearate and 27% dilithium salt of Sample A, as further described below:

Batch size: 2500 grams 2500 g×0.20=500 g of thickener

| Thickener Composition | Ingredient | Moles |
|---|---|---|
| 500 g × 0.73 = 365 g<br>500 g × 0.27 = 135 g | Li 12-OH Stearate<br>Sample A | 365/305.9 = 1.19 |

| Ingredient | Moles | FW (formula weight)/MW (molecular weight) | Grams |
|---|---|---|---|
| LiOH—H2O | 1.19 | 41.9 | 49.9 |
| 12-HSA | 1.19 | 300 | 357.9 |
| Li 12-OH Stearate | | 305.9 | |

Preparation of Dilithium Salt of Sample A

2LiOH—H2O+HOCO—$(CH_2)x$—COOH═Li-(Sample A)-Li+2H2O

MW of Sample A based on saponification value is 223 g/mole 135 g/223 g mole-1=0.6 mole

| Ingredient | Moles | FW/MW | g |
|---|---|---|---|
| LiOH—H2O | 0.6 × 2 = 1.2 | 41.9 | 50 |
| Sample A | 0.6 | 223 | 134 |

A portion of the PAO-6 was added to the grease making vessel along with all of the 12-HSA. The vessel contents where heated to approximately 175° F. or enough to completely melt the fatty acid. The LiOH—H2O was mixed with approximately 100 ml of DI (deionized) water and gently heated. The metal base was then added to the oil and fatty acid solution with constant mechanical stirring.

After approximately 1 hour, Sample A was added to the vessel followed by the required amount of metal base. The temperature was gradually raised to approximately 390° F., to complete the formation of the thickener and to dehydrate the grease. The grease batch was allowed to cool and was subsequently homogenized at 6000 psi.

The chemical and physical properties of the grease were determined as reported in Table 2 below.

TABLE 2

| Property | Method | Result |
|---|---|---|
| Color | Visual | Off-White |
| Appearance | Visual | Smooth |
| Po (unworked penetration) | ASTM D217 | 284 |
| P60 (worked penetration) | ASTM D217 | 308, 306 |
| P10k (worked penetration) | ASTM D217 | 303 |
| DP (dropping point) | ASTM D2285 | 498° F. |
| Oil Separation 24 h at 212° F. | ASTM D6084 | 0.31% |
| PDSC, 302° F., pure dry O2 at 500 psi | ASTM D5483 | Minor exotherm at 37.19 minutes |

Example 2

A two stage reaction process was used to prepare a lithium 12-hydroxystearate complex grease using Sample B, which was 82% w/w purity ODDAME. The first stage of the reaction consisted of reacting a stoichiometric amount of lithium hydroxide monohydrate with 12-hydroxystearic acid. In the second stage, the required amount of metal base was reacted with Sample B. The grease formulation was 20% thickener and 80% PAO-6.

A portion of the PAO-6 was added to the grease making vessel along with all of the 12-HSA. The vessel contents where heated to approximately 175° F. or enough to completely melt the fatty acid. The LiOH—H2O was mixed with approximately 100 ml of DI (deionized) water and gently heated. The base was then added to the oil and fatty acid solution with constant mechanical stirring. After approximately 1 hour, Sample B was added to the vessel followed by the required amount of base. The temperature was gradually raised to approximately 390° F., to complete the formation of the thickener and to dehydrate the grease. The grease batch was allowed to cool and was subsequently homogenized at 6000 psi.

The chemical and physical properties of the grease were determined as reported in Table 3 below.

TABLE 3

| Property | Method | Result |
|---|---|---|
| Color | Visual | Off-White |
| Appearance | Visual | Smooth |
| Po (unworked penetration) | ASTM D217 | 244 |
| P60 (worked penetration) | ASTM D217 | 271 |
| P10K (worked penetration) | ASTM D217 | 315 |
| Dropping Point | ASTM D2265 | >500° F. |
| Oil Separation, 24 h at 212° F. | ASTM D6084 | 0.00% |
| PDSC at 302° F. | ASTM D5483 | Minor exotherm at 60.18 minutes |
| Water Washout @ 175° F. | ASTM D1264 | 9.63% |

Example 3

A two stage reaction process was used to prepare a lithium 12-hydroxystearate complex grease using Sample C, which was a 98% w/w purity ODDAME. The first stage of the reaction consisted of reacting a stoichiometric amount of lithium hydroxide monohydrate with 12-hydroxystearic acid. In the second stage, the required amount of metal base was reacted with Sample C. The grease formulation was 20% thickener and 80% PAO-6.

A portion of the PAO-6 was added to the grease making vessel along with all of the 12-HSA. The vessel contents where heated to approximately 175° F. or enough to completely melt the fatty acid. The LiOH—H2O was mixed with approximately 100 ml of DI (deionized) water and gently heated. The base was then added to the oil and fatty acid solution with constant mechanical stirring.

After approximately 1 hour, Sample C was added to the vessel followed by the required amount of base. The temperature was gradually raised to approximately 392° F., to complete the formation of the thickener and to dehydrate the grease. The grease batch was allowed to cool and was subsequently homogenized at 6000 psi.

The chemical and physical properties of the grease were determined as reported in Table 4 below.

TABLE 4

| Property | Method | Result |
|---|---|---|
| Color | Visual | White |
| Appearance | Visual | Smooth |
| Po (unworked penetration) | ASTM D217 | 282 |
| P60 (worked penetration) | ASTM D217 | 291 |
| P10K (worked penetration) | ASTM D217 | 347 |
| Dropping Point | ASTM D2265 | 489° F. |
| Oil Separation, 24 h at 212° F. | ASTM D6084 | 0.00% |
| PDSC at 302° F. | ASTM D5483 | Minor exotherm at 108.31 minutes |

Example 4

Control

A two stage reaction process was used to prepare a lithium 12-hydroxystearate complex grease using azelaic acid, as a control. The first stage of the reaction consisted of reacting a stoichiometric amount of lithium hydroxide monohydrate with 12-hydroxystearic acid. In the second stage, the required amount of metal base was reacted with azelaic acid. Ten percent additional PAO-6 was added to the grease formulated with azelaic acid. The grease formulation was 18% thickener and 82% PAO-6.

A portion of the PAO-6 was added to the grease making vessel along with all of the 12-HSA. The vessel contents where heated to approximately 175° F. or enough to completely melt the fatty acid. The LiOH—H2O was mixed with approximately 100 ml of DI (deionized) water and gently heated. The base was then added to the oil and fatty acid solution with constant mechanical stirring.

After approximately 1 hour, azelaic acid was added to the vessel followed by the required amount of base. The temperature was gradually raised to approximately 392° F., to complete the formation of the thickener and to dehydrate the grease. The grease batch was allowed to cool and was subsequently homogenized at 6000 psi.

The chemical and physical properties of the grease were determined as reported in Table 5 below.

TABLE 5

| Property | Method | Result |
|---|---|---|
| Color | Visual | Grayish |
| Appearance | Visual | Smooth but less smooth than other samples |

TABLE 5-continued

| Property | Method | Result |
|---|---|---|
| Po (unworked penetration) | ASTM D217 | 245 |
| P60 (worked penetration) | ASTM D217 | 259 |
| P10K (worked penetration) | ASTM D217 | 324 |
| Dropping Point | ASTM D2265 | >500° F. |
| Oil Separation, 24 h at 212° F. | ASTM D6084 | 0.00% |
| PDSC at 302° F. | ASTM D5483 | Minor exotherm at 39.23 minutes |
| Water Washout @ 175° F. | ASTM D1264 | 18.01% |

Complex grease samples with similar consistencies as in Sample B and azelaic acid (Examples 2 and 4, respectively) were tested for water resistance properties via ASTM D1264. The method measures the amount of grease removed from a bearing under exposure to a constant water stream. Significantly, grease prepared from Sample B had a nearly two-fold improved response at 9.63% compared to the azelaic standard at 18.01%, consistent with the reduced water solubility of the long-chain dibasic ester (ODDAME) complexing agent.

What is claimed is:

1. A grease composition comprising: (a) about 75 to 85 weight percent of a lubricating base oil comprising a polyalphaolefin base oil, and (b) about 15 to 25 weight percent of a thickener component comprising dimethyl 1,18-octadecanedioate and lithium hydroxide.

2. The grease composition of claim 1, wherein the lubricating base oil comprises a mineral oil, a synthetic oil, a natural oil, or a natural oil derivative, individually or in combinations thereof.

3. The grease composition of claim 2, wherein the lubricating base oil comprises a polyalphaolefin base oil.

4. The grease composition of claim 1, wherein the thickener component further comprises 12-hydroxystearic acid and or ester derivatives thereof.

5. The grease composition of claim 4, wherein the thickener component comprises 12-hydroxystearate esters.

* * * * *